US006250971B1

(12) United States Patent
Chen

(10) Patent No.: US 6,250,971 B1
(45) Date of Patent: Jun. 26, 2001

(54) ELECTRICAL CONNECTOR

(75) Inventor: Chu-Mei Chen, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/330,390

(22) Filed: Jun. 11, 1999

(30) Foreign Application Priority Data

Mar. 30, 1999 (TW) ..... 88204824

(51) Int. Cl.[7] ..... H01R 13/40
(52) U.S. Cl. ..... 439/733.1; 439/80
(58) Field of Search ..... 439/733.1, 869, 439/444, 79, 80, 62, 395, 389–405

(56) References Cited

U.S. PATENT DOCUMENTS 4,230,384 * 10/1980 Anhalt ..... 439/751
4,909,754 * 3/1990 Paradis ..... 439/405
5,709,556 * 1/1998 Tan et al. ..... 439/79
5,782,644 * 7/1998 Kiat ..... 439/79

* cited by examiner

*Primary Examiner*—Neil Abrams
*Assistant Examiner*—J. F. Duverne
(74) *Attorney, Agent, or Firm*—Wei Te Chung

(57) ABSTRACT

An electrical connector comprises a dielectric housing (2), a number of contacts (4) in the housing, and a shield (3) enclosing the housing. Each contact comprises a contacting portion (40) for electrically contacting a corresponding terminal of a mating connector, an engaging portion (41) for securely latching within a corresponding channel, and a joining portion (42) for electrically connecting with a circuit board. The engaging portion of each contact defines a hollow area (410) symmetrical about a center line for providing the engaging portion with appropriate resilience and for allowing the engaging portion to inwardly deform. A bent portion (43) is further formed between the engaging portion and the joining portion of each contact, and has a smaller width than other portions of the contact for facilitating a bending operation by a tool and for preventing deflection of the joining portion.

3 Claims, 5 Drawing Sheets

ELECTRICAL CONNECTOR

BACKGROUND OF THE INVENTION

The present invention relates to an electrical connector, and particularly to an electrical connector having contacts which facilitate assembly thereof.

As connector size is required to be smaller and smaller, a space between two contacts of the connector is getting closer and closer. Such a connector is termed as a high density connector. A dielectric housing of a high density connector comprises thin partition walls for spacing adjacent contacts. However, the thin partition walls are easily damaged due to large forces exerted thereon by the contacts during insertion into the housing.

A pertinent conventional connector is disclosed in Taiwan Patent Application No. 86207970. Referring to FIGS. 4 and 5, a conventional electrical connector commonly comprises a dielectric housing 6 defining a plurality of passageways 60 for receiving a plurality of contacts 7 therein. The contacts 7 are received in the corresponding passageways 60. Each contact 7 comprises a mating portion 70, a joining potion 71, and an engaging portion 72 between the mating portion 70 and the joining portion 71. The engaging portion 72 of each contact 7 forms a pair of barbs 720 on opposite lateral edges thereof for securing within the corresponding passageway 60 of the housing 6. A resilient bent portion 721 is formed between the joining portion 71 and the engaging portion 72 and has a width substantially the same as other portions of each contact 7. The joining end 71 is apt to deflect due to inner stress or other reasons when being bent to form the bent portion 721 thereby resulting in misalignment between the joining portions 71 and corresponding holes of a circuit board. Therefore, an improved electrical connector which can provide stable and reliable signal transmission is required.

BRIEF SUMMARY OF THE INVENTION

A main object of the present invention is to provide an electrical connector having contacts which prevent damage from occurring to a dielectric housing during assembly thereby facilitating assembly of the electrical connector.

Another object of the present invention is to provide an improved electrical connector having contacts which avoid deflection thereby enhancing signal transmission quality.

In accordance with one aspect of the present invention, an electrical connector comprises an elongate dielectric housing, a plurality of contacts received in the housing, and a shield enclosing the housing. The housing forms a pair of mating portions at opposite ends thereof. Each mating portion defines a receiving chamber therein. A mating board extends into each receiving chamber cantilevered therein. Each mating board defines a plurality of passageways for receiving the corresponding contacts therein. An opening is defined in a top face of a peripheral wall of each mating portion in communication with the receiving chamber.

Each contact comprises a contacting portion received in the corresponding passageways of the housing, an engaging portion latching within the passageway, and a joining portion electrically connecting with a circuit board. The engaging portion of each contact defines a hollow area symmetrical about a centerline thereby providing the engaging portion with proper resilience. Such a designation of the hollow area of the contact only exerts a small stress against opposite partition walls of the corresponding passageways thereby effectively preventing the engaging portions of the contacts from damaging the partition walls. Moreover, such a designation provides the engaging portion of each contact with appropriate resilience for securely latching within the corresponding passageway.

A bent portion is formed between the engaging portion and the joining portion of each contact. The width of the bent portion is smaller than the contacting portion and the engaging portion. Thus, a tool can easily fix it at its required configuration without any undue deflection after the tool is released from the bent portion.

Other objects, advantages and novel features of the invention will become more apparent from the following detailed description when taken in conjunction with the accompanying drawings.

DETAILED DESCRIPTION OF THE INVENTION

Figure 1:
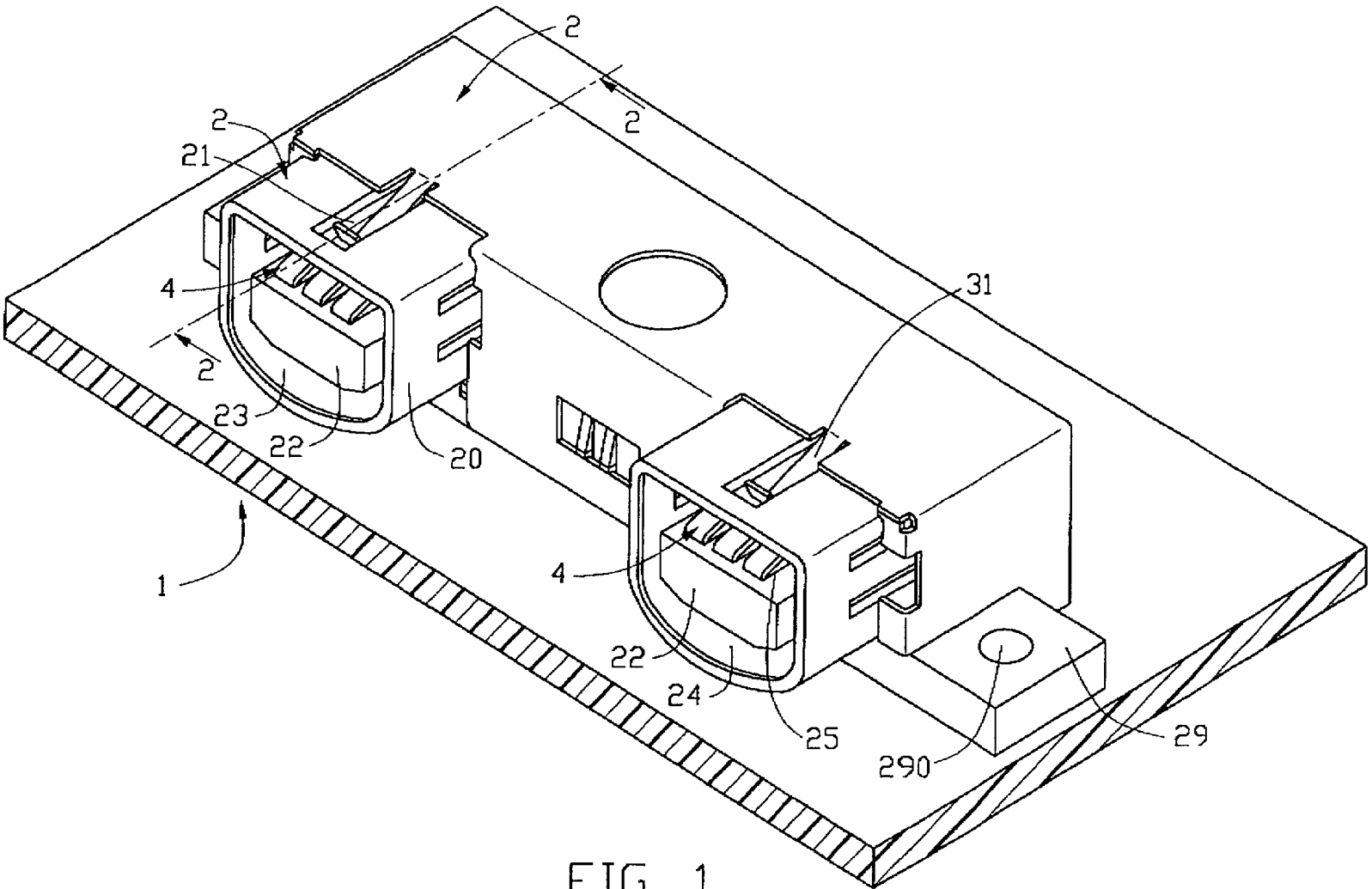
FIG. 1 is a perspective view of an improved electrical connector of the present invention.
Figure 2:
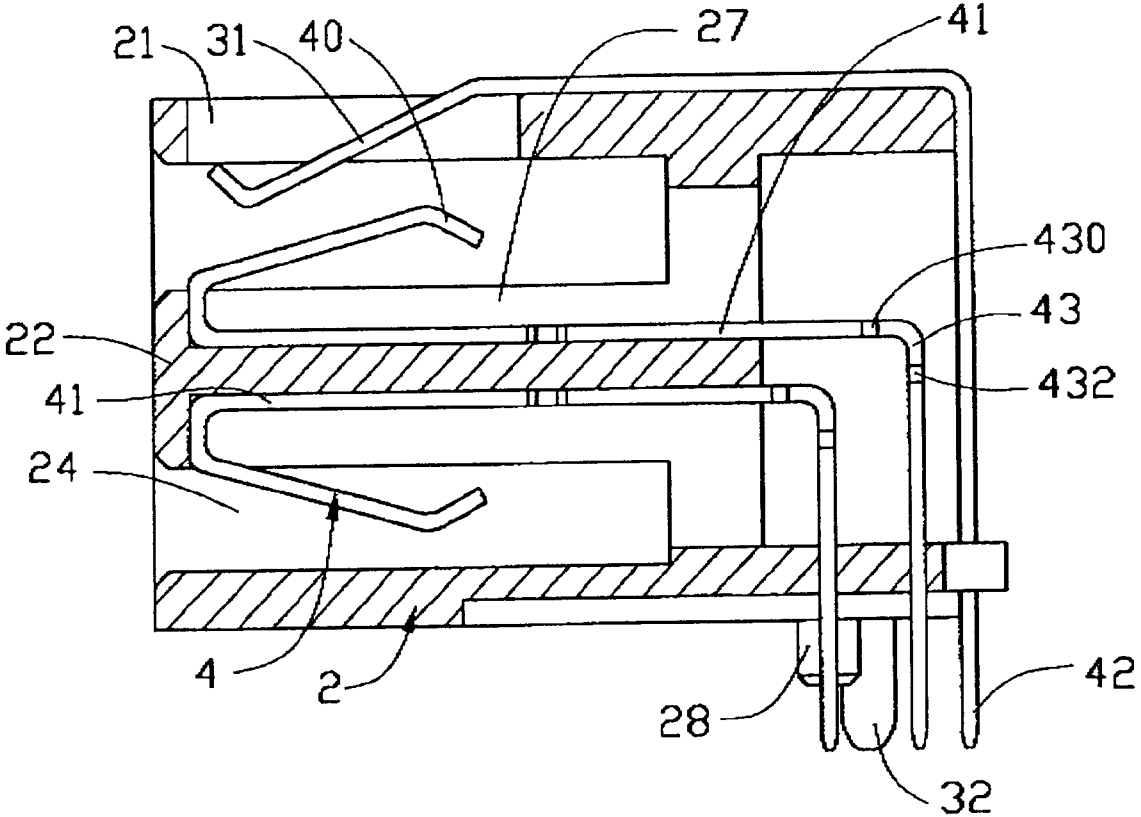
FIG. 2 is a cross sectional view taken along line 2—2 of FIG. 1.

Referring to FIGS. 1 and 2, an electrical connector in accordance with the present invention is mounted on a circuit board 1 and comprises an elongate dielectric housing 2, a shield 3 enclosing the housing 2, and a plurality of contacts 4 received in the housing 2.

The housing 2 comprises a main body, a pair of mating portions 20 outwardly projecting proximate opposite sides of the main body, a bottom board 29 below the main body and extending beyond the opposite ends of the main body for supporting the housing 2. Each mating portion 20 defines a receiving chamber 24 enclosed by a peripheral wall 23 and a mating board 22 extending from the housing 2 into the receiving chamber 24. Each mating board 22 defines a plurality of passageways 25 in opposite upper and lower faces thereof for receiving the corresponding contacts 4. A partition wall 27 is formed between adjacent passageways 25 for properly spacing the contacts 4. An opening 21 is defined in a top face of the peripheral wall 23. A mounting hole 290 is defined in each bottom board 29 for screwing the connector to the circuit board 1. A guiding post 28 downwardly extends from a bottom surface of each bottom board 29 for properly positioning the connector on the circuit board 1.

The shield 3 covers the main body of the housing 2 and defines a pair of channels (not labeled) corresponding to the mating sections 20. A pair of spring beams 31 integrally extend from an upper surface of the shield 2 into the corresponding openings 21 of the mating sections 20 for electrically contacting a shell of the mating connector thereby forming a grounding circuit therethrough. A pair of mounting legs 32 downwardly extend from the shield 3 for fixing the shield 3 to the circuit board 1.

Figure 3:
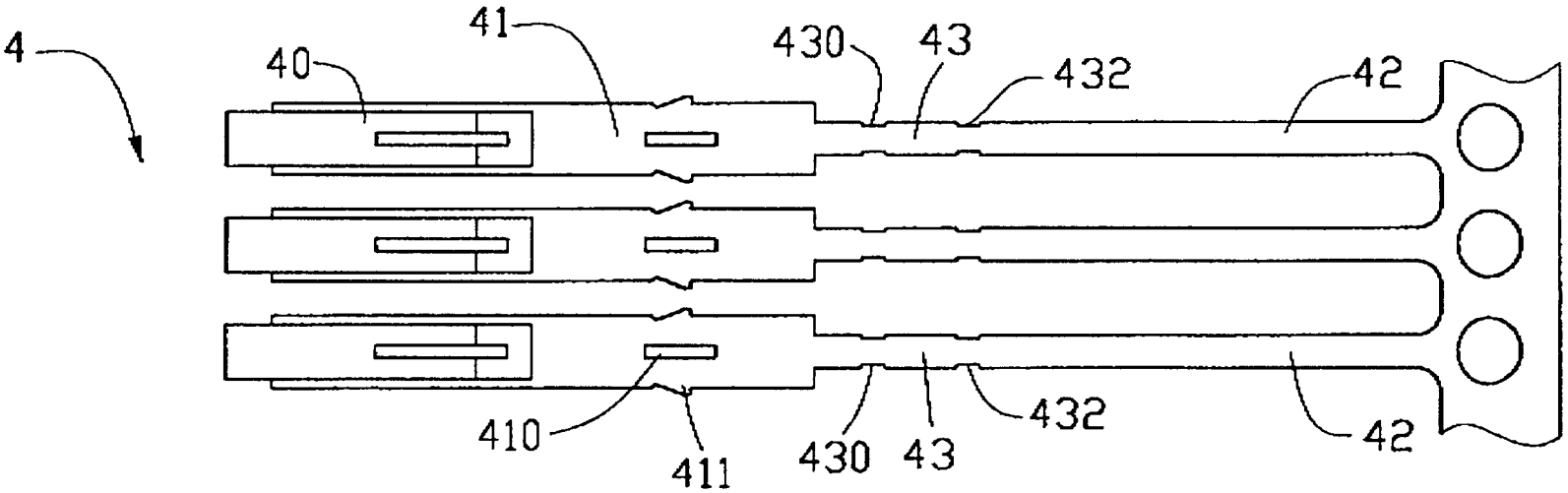
FIG. 3 is a plan view of contacts of the electrical connector of the present invention, wherein the contacts are commonly connected to a carrier.
Figure 4:
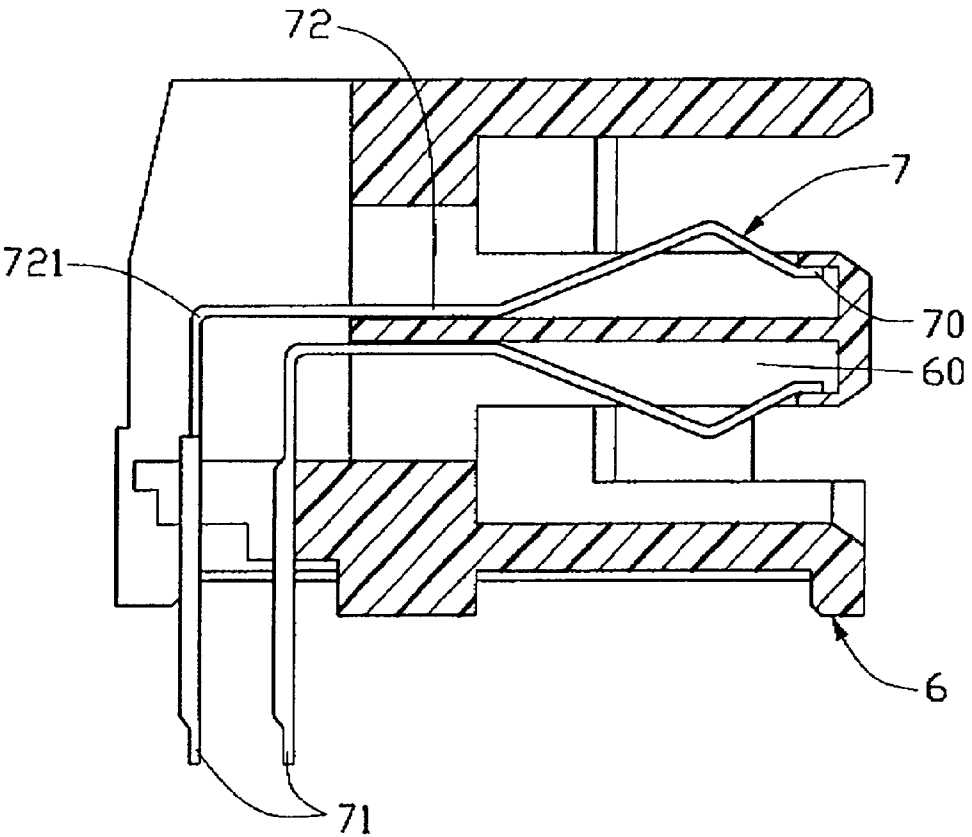
FIG. 4 (PRIOR ART)
FIG. 4 is a cross sectional view of a conventional electrical connector.
Figure 5:
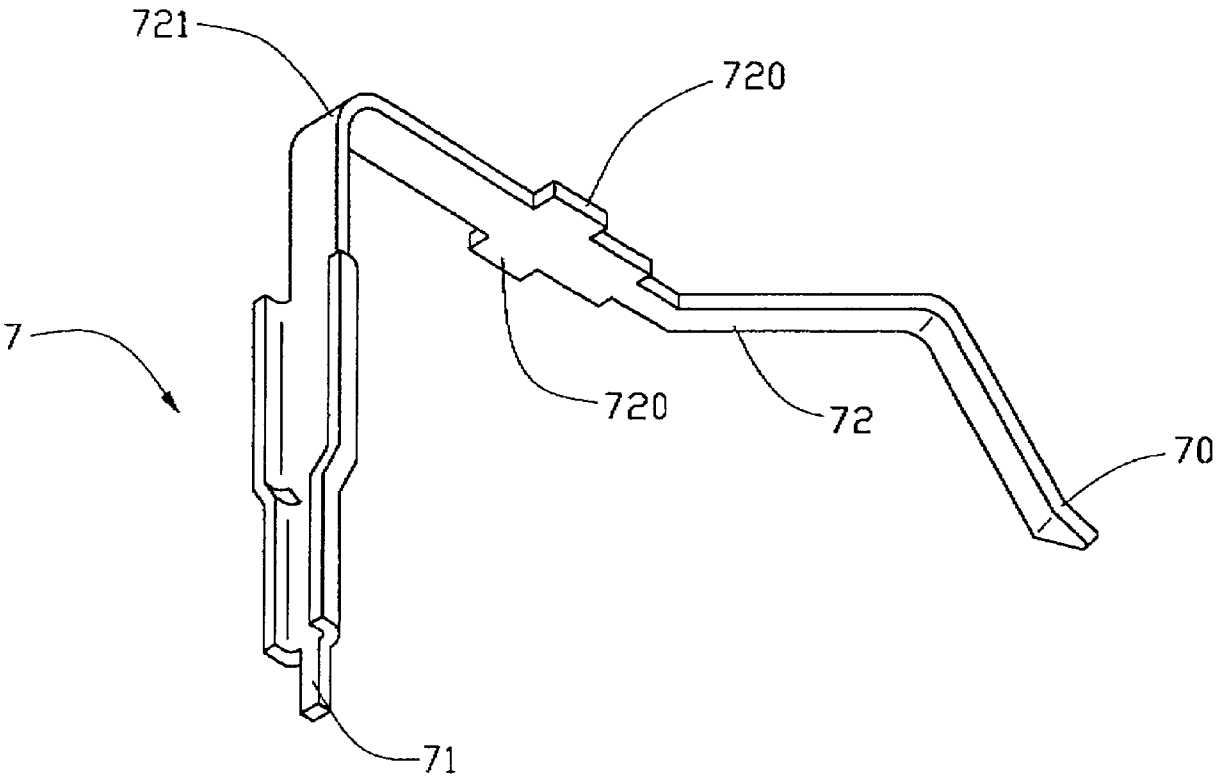
FIG. 5 (PRIOR ART)
FIG. 5 is a perspective view of a contact of the conventional electrical connector.

Referring to FIGS. 2 and 3, each contact 4 comprises a contacting portion 40 for electrically contacting a corresponding terminal of the mating connector, an engaging portion 41 forming barbs 411 on opposite lateral edges thereof for securely fixing within the corresponding passageway 25 of the housing 2, and a joining portion 42 for electrically connecting with the circuit board 1.

A hollow area is defined in the middle of the engaging portion 41 of each contact 4. In the embodiment shown, the hollow area is an aperture 410, but could be another structure for providing the engaging portion 41 with proper resilience to promote inward deformation thereof. The hollow area is symmetrical about a center line of the engaging portion 41 resulting in symmetrical deformation of the engaging portion 41 and exerting substantially identical forces on the opposite partition walls 27 of each passageway 25 when the contacts 4 are inserted therein. Due to the resilience of the engaging portions 41 provided by the hollow area, the force exerted by the contacts 4 upon the partition walls 27 is reduced. Thus, the partition walls 27 are protected from damage. Furthermore, the engaging portions 41 of the contacts 4 can be easily inserted into and secured within the corresponding passageways 25.

A bent portion 43 is further formed between the joining section 42 and the engaging section 41 of each contact 4. The bent portion 43 of each contact 4 further forms two narrow portions 430, 432. The narrow portions 430, 432 are narrower than the other portions 40, 41, 42 for facilitating a bending operation by a tool. Thus, the thinner bent portion 43 of each contact 4 can be properly bent while decreasing an accumulation of stress thereon after being bent, thereby effectively preventing the joining portion 42 from deflection. The contacts shown in FIG. 2 are obtained by cutting the contacts in FIG. 3 away from a carrier (not labeled), to which joining sections 42 are commonly connected, and then bending the bent portions 43.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a mating portion at a lateral side thereof, the mating portion defining a receiving chamber and a mating board in the receiving chamber, the mating board defining a plurality of passageways; and a plurality of contacts received in corresponding passageways of the mating portion, each contact comprising a contacting portion for electrically mating with a mating connector positioned in corresponding passageway, an engaging portion for latching within corresponding passageways, and a joining portion for electrically connecting with a circuit board, the engaging portion defining a hollow area thereof for providing deformability thereof; wherein a bent portion is formed between the joining portion and the engaging portion, the bent portion has two spaced narrow portions which are narrower than the engaging portions and the joining portions for facilitating a bending operation thereof, and the joining portion is bent with respect to the engaging portion.

2. The electrical connector as claimed in claim 1, wherein the hollow area of the engaging portion of each contact is symmetrical about a center line of the engaging portion.

3. The electrical connector as claimed in claim 1, wherein the hollow area of the engaging portion of each contact is an elongate, rectangular aperture.

* * * * *